United States Patent [19]

Kikuchi et al.

[11] Patent Number: 4,563,217

[45] Date of Patent: Jan. 7, 1986

[54] ELECTROLESS COPPER PLATING SOLUTION

[75] Inventors: Hiroshi Kikuchi, Zushi; Akira Tomizawa; Hitoshi Oka, both of Yokohama, all of Japan

[73] Assignee: Hitachi, Ltd., Tokyo, Japan

[21] Appl. No.: 623,173

[22] Filed: Jun. 22, 1984

[30] Foreign Application Priority Data

Jul. 25, 1983 [JP] Japan ..... 58-134328
Dec. 13, 1983 [JP] Japan ..... 58-233599

[51] Int. Cl.[4] ..... C23C 3/02

[52] U.S. Cl. ..... 106/1.23; 106/1.26; 427/437; 427/443.1

[58] Field of Search ..... 106/1.23, 1.26

[56] References Cited

U.S. PATENT DOCUMENTS 3,615,733 10/1971 Shipley et al. ..... 106/1.26
3,804,638 4/1974 Jonker et al. ..... 106/1.26
3,915,717 10/1975 Feldstein et al. ..... 106/1.26
4,248,633 2/1981 Heijnen et al. ..... 106/1.26
4,371,397 2/1983 Honma et al. ..... 106/1.26

FOREIGN PATENT DOCUMENTS 0019430 2/1979 Japan .

*Primary Examiner*—Lorenzo B. Hayes
*Attorney, Agent, or Firm*—Antonelli, Terry & Wands

[57] ABSTRACT

An electroless copper plating solution comprising cupric ions, complexing agents, a reducing agent, a pH adjustor, a polyoxyethylene series surface active agent, these being conventionally used, and (i) an inorganic compound containing at least Si or Ge, or (ii) a cationic surface active agent, or (iii) an inorganic compound containing at least Si, Ge or V and a cationic surface active agent, can give plated films with excellent mechanical properties even if operated for a long period of time with excellent stability of the plating solution.

23 Claims, 1 Drawing Figure

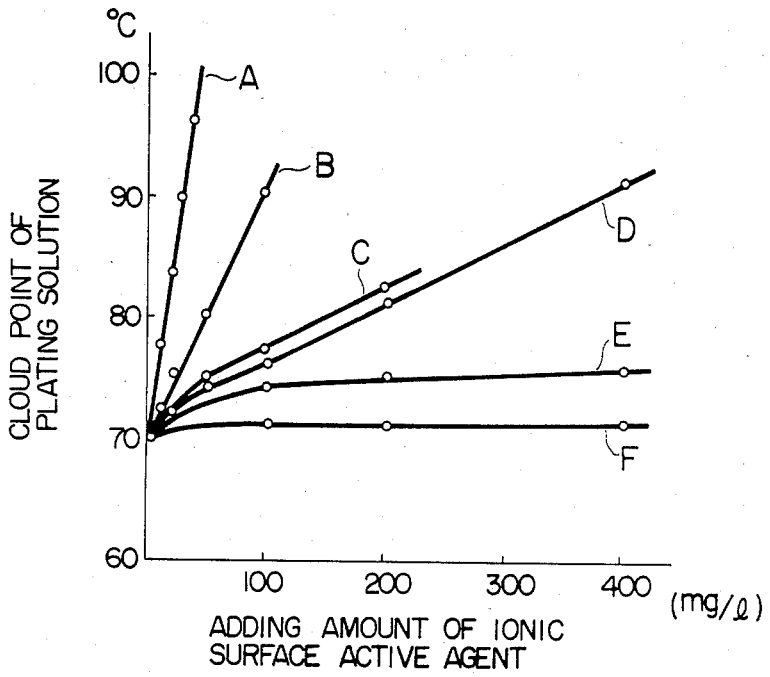
°C
100
90
80
70
60
CLOUD POINT OF PLATING SOLUTION
A
B
C
D
E
F
100
200
300
400
(mg/ℓ)
ADDING AMOUNT OF IONIC SURFACE ACTIVE AGENT

ELECTROLESS COPPER PLATING SOLUTION

BACKGROUND OF THE INVENTION

This invention relates to an electroless copper plating solution, and particularly to an electroless copper plating solution which can give an electroless plated copper film with high strength.

In order to give electroless plated copper films with high strength, there is proposed an electroless copper plating solution comprising copper(II) ions, a reducing agent for copper(II) ions, a complexing agent for copper(II) ions, a pH adjustor, $\alpha,\alpha'$-dipyridyl, polyethylene glycol, and an alkali-soluble inorganic silicon compound (Japanese Patent Appln Kokai (Laid-Open) No. 19430/79).

But this electroless copper plating solution uses polyethylene glycol as surface active agent and contains the alkali-soluble inorganic silicon compound in an amount of as low as 5 to 100 mg/l in terms of $SiO_2$ (0.08 to 1.7 mmole/l in terms of Si atom), so that the resulting electroless plated copper film is improved in tensile strength and elongation but the stability of the plating solution is not good and there takes place abnormal deposition (a phenomenon of depositing copper on outside of desired portions) when the plating solution is used continuously for a little prolonged time.

SUMMARY OF THE INVENTION

It is an object of this invention to provide an electroless copper plating solution excellent in solution stability and capable of forming electroless plated copper films with high mechanical properties.

This invention provides an electroless copper plating solution comprising (a) copper ions,
(b) a copper(II) ion complexing agent,
(c) a reducing agent,
(d) a pH adjustor,
(e) a polyoxyethylene series surface active agent,
(f) a copper(I) ion complexing agent, and
(g) (i) an inorganic compound containing at least silicon or germanium, or
(ii) a cationic surface active agent, or
(iii) an inorganic compound containing at least silicon, germanium or vanadium and a cationic surface active agent.

BRIEF DESCRIPTION OF THE DRAWING

The attached drawing is a graph showing changes of cloud points of a plating solution containing a polyoxyethylene series nonionic surface active agent when various ionic surface active agents are added thereto.

DESCRIPTION OF THE PREFERRED EMBODIMENTS

The components (a) to (f) are the same as those used in conventional electroless copper deposition solutions and comprise the following compounds.

The copper ions (cupric ions) can be supplied by organic and inorganic cupric salts alone or as a mixture thereof, for example, $CuSO_4.5H_2O$, cupric nitrate, cupric chloride, cupric acetate, etc. The concentration of copper(II) ions in the plating solution is usually 1.27 to 50 g/l.

As the copper(II) ion complexing agent, there can be used ethylenediaminetetraacetic acid (EDTA), sodium salts (mono-, di-, tri- and tetrasodium salts) of EDTA, Rochelle salts, hydroxyethylethylenediaminetriacetic acid (HEDTA), diethylenetriaminepentaacetic acid (DTPA), iminodiacetic acid (IDA), nitrilotriacetic acid (NTA), alkali metal salts (e.g. sodium, potassium, lithium salts) of these acids, alone or as a mixture thereof. When EDTA.2Na is used, it is usually used in an amount of 15 to 200 g/l. When other copper(II) ion complexing agents are used, they are used in a stoichiometrically equal amount to the amount of EDTA.2Na.

As the reducing agent for copper(II) ions, there can be used formaldehyde, paraformaldehyde, borohydrides, e.g., sodium borohydride, potassium borohydride, hydrazine, etc. When formaldehyde is used, there can preferably be used 2 to 10 ml/l in the form of 37% formaline solution. When other reducing agents are used, they are used in a stoichiometrically equal amount to the amount of formaldehyde.

As the pH adjustor, there can be used alkali metal hydroxides such as sodium hydroxide, potassium hydroxide, etc., alone or as a mixture thereof. The pH adjustor can be used in an amount sufficient to make the pH of plating solution 11 to 13.5.

The polyoxyethylene series surface active agent includes in this invention amine series polyoxyethylene surface active agents (the term "amine series" means "a secondary amine and/or tertiary amine containing") as well as alkyl ester, alkyl ether and acetylene-bond-containing polyoxyethylene surface active agents. Examples of the polyoxyethylene series surface active agents are as follows: Amine Series Polyoxyethylene Surface Active Agents:

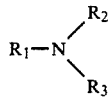

(1)

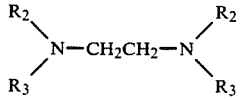

(2)

wherein $R_1$ is an alkyl group preferably having 8 to 18 carbon atoms; $R_2$ and $R_3$ are independently a hydrogen atom, a group of the formula: $(CH_2CH_2O)_n$—H, in which n is preferably 5 to 150, a group of the formula:

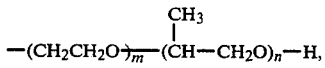

in which m and n are independently preferably 5 to 150.

Among them, preferred ones are polyethylene glycol stearylamine (n=15, 20), and

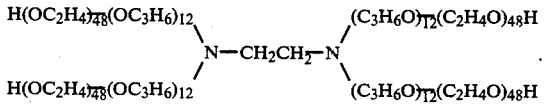

Alkylamine Series Polyoxyethylene Surface Active Agents:

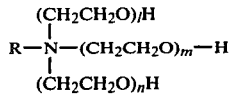

(3)

wherein R is an alkyl group preferably having 8 to 18 carbon atoms; l, m and n are independently preferably 5 to 150.

Alkyl Ester Series Polyoxyethylene Surface Active Agents:

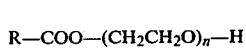

(4)

wherein R is an alkyl group preferably having 8 to 18 carbon atoms; n is preferably 5 to 150.

Alkyl Aryl Ether Series Polyoxyethylene Surface Active Agents:

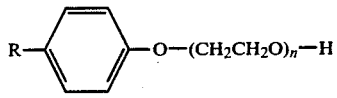

(5)

wherein R is an alkyl group preferably having 8 to 18 carbon atoms; n is preferably 5 to 150.

Acetylene-bond-containing Polyoxyethylene Surface Active Agents:

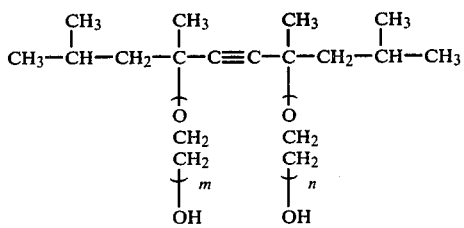

(6)

wherein m and n are independently preferably 5 to 150.

These polyoxyethylene series surface active agents can be used alone or as a mixture thereof.

When these surface active agents are used in combination with the component (g) (i) the inorganic compound containing at least silicon or germanium, there can be preferably used amine series polyoxyethylene surface active agents represented by the formulae (1) to (3) alone or as a mixture thereof or in combination with one or more other polyoxyethylene surface active agents represented by the formulae (4) to (6).

The surface active agent is usually used in an amount of 0.01 to 2 mmole/l, preferably 0.1 to 1 mmole/l.

As the copper(I) ion complexing agent, there can be used $\alpha,\alpha'$-dipyridyl and derivatives thereof, o-phenanthroline and derivatives thereof (e.g., neocuproine), cuproine, bathocuproine, compounds containing —CN group such as cyanides (e.g., NaCN, KCN, NiCN, $Co(CN)_2$, $Na_4[Fe(CN)_6]$, $K_4[Fe(CN)_6]$, $Na_3[Fe(CN)_6]$, $K_3[Fe(CN)_6]$), alone or as a mixture thereof. The copper(I) ion complexing agent can be used in an amount of 0.001 to 1 mmole/l usually, and preferably 0.005 to 0.7 mmole/l.

As the component (g), there are three cases (i) through (iii) depending on purposes.

The case (i) is the use of an inorganic compound containing at least silicon or germanium.

Examples of the inorganic compound containing at least silicon or germanium is silicon, orthosilicates such as alkali metal orthosilicates (e.g. sodium orthosilicate), metasilicates such as alkali metal metasilicates (e.g. sodium metasilicate), silicon hydride, etc., germanium, germanium oxide, germanium hydride, etc. These compounds can be used alone or as a mixture thereof.

The inorganic compound containing at least silicon or germanium can be used in an amount of 2 mmole/l or more, preferably 2 to 100 mmole/l, more preferably 3 to 30 mmole/l, in terms of silicon or germanium atom.

When the inorganic compound containing at least silicon or germanium is used, the electroless copper plating solution not only is remarkably improved in stability without causing abnormal deposition even if used continuously for a long period of time but also can form a plated copper film excellent in mechanical properties such as tensile strength and elongation.

The case (ii) is the use of a cationic surface active agent. There can also be obtained excellent stability of the plating solution even if used for a long period of time.

Examples of the cationic surface active agent are quaternary ammonium salts, pyridinium salts, etc. Among quaternary ammonium salts, tetraalkylammonium salts and trialkylbenzylammonium salts are preferable. Examples of tetraalkylammonium salts are hexadecyltrimethylammonium salts, launyltrimethylammonium salt, etc. Examples of trialkylbenzylammonium salts are stearyldimethylbenzylammonium salt, etc. Examples of pyridinium salts are dodecylpyridinium salt, etc. These cationic surface active agents can be used alone or as a mixture thereof.

The cationic surface active agent can be used in an amount of preferably 0.02 to 2 mmole/l, more preferably 0.1 to 1 mmole/l.

In contrast, anionic surface active agents and amphoteric surface active agents do not give a good effect on the stability of plating solution as shown in the attached drawing.

The case (iii) is the use of an inorganic compound containing at least silicon, germanium or vanadium and a cationic surface active agent. As the inorganic compounds containing at least silicon or germanium, there can be used those described in the case (i) above. Examples of the inorganic compound containing at least vanadium are vanadium, vanadium oxide, orthovanadates such as sodium orthovanadate, metavanadates such as sodium metavanadate. These inorganic compounds containing at least silicon, germanium or vanadium can be used alone or as a mixture thereof.

The inorganic compound containing at least silicon, germanium or vanadium can be used in an amount of preferably 2 to 100 mmole/l, more preferably 3 to 30 mmole/l in terms of Si, Ge or V atom.

As the cationic surface active agent, there can be used those described in the case (ii) mentioned above in an amount of preferably 0.02 to 2 mmole/l, more preferably 0.1 to 1 mmole/l.

By the case of the inorganic compound containing at least silicon, germanium or vanadium and the cationic surface active agent, the stability of the plating solution can be improved more effectively than the case (i).

This invention is illustrated by way of the following Examples.

EXAMPLE 1

Electroless copper plating solutions as shown in Table 1, Nos. 1 to 10 (pH 12.3), were prepared and plating was conducted at 70° C. on stainless steel plates. The plating load factor was made constant at 1 $dm^2/l$.

Each stainless steel plate had been subjected to instant pyrophosphoric acid electroplating of copper to form plating nucleus, followed by electroless copper deposition.

With the progress of plating for a long period of time, since copper(II) ions and other components were consumed by the plating reaction, concentrations of individual components were detected automatically and shortage of individual components was supplemented automatically.

The electroless plating was conducted while maintaining the concentrations of individual components always constant as mentioned above until the thickness of deposited metallic copper becomes about 50 μm. Then, the plated film was peeled off from the stainless steel plate and subjected to the conventional tensile test.

The results are as shown in Table 1.

gation 4% or more. These properties correspond to those (tensile strength 50–65 $kg/mm^2$, elongation 4–6%) of electrodeposited copper films, particularly those obtained by using a pyrophosphoric acid-copper bath. Further, the plating solutions of Nos. 3 to 8 were remarkably stable after continuous 100 hours' operation without causing abnormal deposition.

As is clear from the results in Table 1, the adding amount (or content) of sodium metasilicate necessary for giving such excellent properties is 3 to 30 mmole/l in terms of Si atom (85 to 850 mg/l as Si).

On the other hand, in the case of No. 10, since the silicon ions to be adsorbed on the reaction area are present in excess, the plating reaction was inhibited to form no plated film. In the case of Nos. 1 and 2 wherein the silicon compound was used in a too small amount or not used, mechanical properties of the plated films are not good (tensile strength less than 50 $kg/mm^2$, elongation 6–8%) and there took place abnormal deposition

TABLE 1

| | Composition of electroless copper plating solution* | | | | | | Mechanical properties of plated film | | Stability of plating solution after 100 hours' plating *** |
|---|---|---|---|---|---|---|---|---|---|
| No. | $CuSO_4.5H_2O$ (mole/l) | Complexing agent: EDTA.2Na (mole/l) | Formaldehyde (mole/l) | Copper(I) ion complexing agent (mole/l) | Surface active agent** (mole/l) | Si compound (mmole/l) $Na_2SiO_3.9H_2O$ | Tensile strength ($Kg/mm^2$) | Elongation (%) | |
| 1 | 0.048 | 0.096 | 0.037 | α,α'dipyridyl $1.2 \times 10^{-4}$ | SA-1 $2.2 \times 10^{-4}$ | 0 | 34 | 8 | x |
| 2 | " | " | " | α,α'dipyridyl $1.2 \times 10^{-4}$ | SA-1 $2.2 \times 10^{-4}$ | 1 | 43 | 6 | x |
| 3 | " | " | " | α,α'dipyridyl $1.2 \times 10^{-4}$ | SA-1 $2.2 \times 10^{-4}$ | 3 | 50 | 6 | o |
| 4 | 0.02 | 0.04 | 0.007 | Neocuproine $4.8 \times 10^{-6}$ | SA-1 $2.2 \times 10^{-4}$ | 3 | 51 | 7 | o |
| 5 | 0.08 | 0.16 | 0.037 | α,α'-dipyridyl $1.2 \times 10^{-4}$ | SA-1 $2.2 \times 10^{-4}$ | 10 | 55 | 6 | o |
| 6 | 0.048 | 0.096 | " | α,α'-dipyridyl $1.2 \times 10^{-4}$ | SA-2 $2.2 \times 10^{-4}$ | 10 | 53 | 6 | o |
| 7 | " | " | " | α,α'-dipyridyl $1.2 \times 10^{-4}$ | SA-1 $2.2 \times 10^{-4}$ | 30 | 60 | 5 | o |
| 8 | " | " | " | α,α'-dipyridyl $1.2 \times 10^{-4}$ | T-707 $2.2 \times 10^{-4}$ | 30 | 62 | 5 | o |
| 9 | " | " | " | α,α'-dipyridyl $1.2 \times 10^{-4}$ | SA-1 $2.2 \times 10^{-4}$ | 100 | 67 | 5 | o |
| 10 | " | " | " | α,α'-dipyridyl $1.2 \times 10^{-4}$ | SA-1 $2.2 \times 10^{-4}$ | 300 | Impossible to measure | | — |

Notes on TABLE 1:

*pH = 12.3 (by NaOH)

**Sa: $R_1-N(R_2)(R_3)$

SA-1: $R_1 = C_{18}H_{37}-$, $R_2 = -(C_2H_4O)_{15}-H$, $R_3 = H$

SA-2: $R_1 = C_{18}H_{37}-$, $R_2 = -(C_2H_4)_{20}-H$ $R_3 = -(C_2H_4)_{20}-H$

T-707: $(R_2)(R_3)N-CH_2CH_2-N(R_2)(R_3)$, $R_2, R_3 = -(C_3H_6O)_{12}-(C_2H_4O)_{48}-H$

***x = no good o = good

In Nos. 3 through 8, the plating rate was about 0.5 to 3.0 μm/hr and the plating solutions were remarkably stable during the plating. Further, there was not admitted a tendency to decompose the plating solutions, said tendency being inherent to the electroless copper plating solution. The resulting plated films of Nos. 3 to 8 were excellent in gloss of metallic copper as well as in mechanical properties. Tensile strength measured by using a tensile tester was 50 $kg/mm^2$ or more and elonduring 100 hours' continuous operation.

As mentioned above, by adjusting the content of Si compound in a suitable amount, mechanical properties of the resulting plated films can be improved and the stability of the plating solution can also be improved.

Further, the use of amine series ethoxy surface active agents are preferable when a Si compound is used, as shown in Table 1. In addition, a phenanthroline derivative such as neocuproine (2,9-dimethyl-1,10-phenanthroline) has the same effect as α,α'-dipyridyl as the copper(I) ion complexing agent.

EXAMPLE 2

Using electroless copper plating solutions as shown in Table 2, Nos. 11 to 20, electroless copper plating was conducted in the same manner as described in Example 1. Plated films thus obtained had properties as shown in Table 2.

were remarkably stable after continuous 100 hours' operation without causing abnormal deposition.

Therefore, the electroless copper plating solutions of Nos. 13 to 19 are suitable for practical use.

EXAMPLE 3

Using electroless copper plating solutions as shown in Table 3, Nos. 21 to 24, wherein various Si compounds which were not dissolved rapidly in the plating solutions were used in an amount of 10 g/l, electroless copper plating was conducted in the same manner as described in Example 1. In order to dissolve the Si compounds, each Si compound was placed in a filter chamber made of polypropylene and each plating solution heated at 70° C. was recycled through the filter chamber for 5 to 50 hours to dissolve the Si compound.

Plated films thus obtained had excellent properties as shown in Table 3. All the plating solutions were remarkably stable after continuous 100 hours' operation without causing abnormal deposition.

TABLE 2

| | Composition of electroless copper plating solution | | | | | | Mechanical properties of plated film | | Stability of plating solution after 100 hours' plating |
|---|---|---|---|---|---|---|---|---|---|
| No. | $CuSO_4.5H_2O$ (mole/l) | Copper(II) ion complexing agent* (mole/l) | Formaldehyde (mole/l) | Copper(I) ion complexing agent (mole/l) | Surface active agent** (mole/l) | Si compound $Na_2SiO_3.9H_2O$ (mmole/l) | Tensile strength (kg/mm²) | Elongation (%) | |
| 11 | 0.048 | EDTA.2Na 0.096 | 0.037 | α,α'-dipyridyl $1.28 \times 10^{-4}$ | SA-1 $2.2 \times 10^{-4}$ | 0.3 | 33 | 8 | x |
| 12 | " | EDTA.2Na 0.096 | " | α,α'-dipyridyl $1.28 \times 10^{-4}$ | SA-1 $2.2 \times 10^{-4}$ | 1 | 48 | 7 | x |
| 13 | " | EDTA.2Na 0.096 | " | α,α'-dipyridyl $1.28 \times 10^{-4}$ | SA-1 $2.2 \times 10^{-4}$ | 3 | 54 | 4 | o |
| 14 | " | EDTA.2Na 0.096 | " | α,α'-dipyridyl $1.28 \times 10^{-4}$ | SA-1 $2.2 \times 10^{-4}$ | 3 | 51 | 6 | o |
| 15 | " | HEDTA.3Na 0.096 | " | α,α'-dipyridyl $1.28 \times 10^{-4}$ | SA-1 $2.2 \times 10^{-4}$ | 3 | 50 | 7 | o |
| 16 | " | HEDTA.3Na 0.096 | 0.247 | $1.92 \times 10^{-4}$ | SA-2 $2.2 \times 10^{-4}$ | 10 | 59 | 5 | o |
| 17 | " | DTPA 0.096 | 0.012 | $3.20 \times 10^{-5}$ | SA-2 $2.2 \times 10^{-4}$ | 10 | 50 | 4 | o |
| 18 | " | EDTA.2Na 0.096 | 0.037 | o-phenanthroline $6.4 \times 10^{-4}$ | EDE-1 $2.2 \times 10^{-4}$ | 10 | 53 | 5 | o |
| 19 | " | EDTA.2Na 0.096 | " | α,α'-dipyridyl $6.4 \times 10^{-4}$ | EDE-1 $2.2 \times 10^{-4}$ | 30 | 59 | 4 | o |
| 20 | " | EDTA.2Na 0.096 | 0.037 | $1.28 \times 10^{-4}$ | EDE-1 $2.2 \times 10^{-4}$ | 100 | 65 | 3 | o |

Notes on TABLE 2:
*EDTA.2Na = disodium salt of ethylenediamine-tetraacetic acid
4EDTA.3Na = trisodium salt of hydroxyethyl-ethylenediaminetriacetic acid
DTPA = diethylenetriaminepentaacetic acid
**SA-1, SA-2: see Table 1
EDE-1:

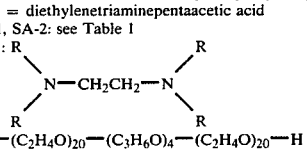

$R = -(C_2H_4O)_{20}-(C_3H_6O)_4-(C_2H_4O)_{20}-H$

The plated films obtained in Nos. 13 to 19 had excellent metallic gloss and high mechanical properties corresponding to those of electrodeposited copper films. The content of sodium orthosilicate in Nos. 13 to 19 was 3 to 30 mmole/l in terms of Si atom, which values are the same as in Example 1. Further, the combination of α,α'-dipyridyl or phenanthroline or a derivative thereof and an amine series ethoxy surface active agent was effective for improving both the elongation and tensile strength. Further, the plating solutions of Nos. 13 to 19

TABLE 3

| | Composition of electroless copper plating solution | | | | | | Mechanical properties of plated film | | Stability of plating solution after 100 hours' plating |
|---|---|---|---|---|---|---|---|---|---|
| No. | $CuSO_4.5H_2O$ (mole/l) | EDTA.2Na (mole/l) | Formaldehyde (mole/l) | α,α'-Dipyridyl (mole/l) | Surface active agent, SA-1 (mole/l) | Si compound (mmole/l)* | Tensile strength (kg/mm²) | Elongation (%) | |
| 21 | 0.048 | 0.096 | 0.037 | $1.2 \times 10^{-4}$ | $2.2 \times 10^{-4}$ | Silica glass powder (5.4) | 50 | 5 | o |
| 22 | " | " | " | " | " | Crystalline silica powder (15) | 55 | 4 | o |
| 23 | " | " | " | " | " | Silica gel (8.0) | 52 | 4 | o |
| 24 | " | " | " | " | " | Silicon | 50 | 5 | o |

TABLE 3-continued

| No. | Composition of electroless copper plating solution: $CuSO_4.5H_2O$ (mole/l) | EDTA.2Na (mole/l) | Formaldehyde (mole/l) | α,α'-Dipyridyl (mole/l) | Surface active agent, SA-1 (mole/l) | Si compound (mmole/l)* | Mechanical properties of plated film: Tensile strength ($kg/mm^2$) | Elongation (%) | Stability of plating solution after 100 hours' plating |
|---|---|---|---|---|---|---|---|---|---|
| | | | | | | powder (3.8) | | | |

Notes
*The value in parentheses is an analytical value of the amount of Si dissolved in the plating solution.
SA-1: See Table 1.

EXAMPLE 4

Using electroless copper plating solutions as shown in Table 4, Nos. 25 to 29, electroless copper plating was conducted in the same manner as described in Example 1.

Plated films obtained by using the plating solution Nos. 26 to 28 had excellent metallic gloss as well as mechanical properties, tensile strength more than 50 $kg/mm^2$ and elongation 4% or more.

Germanium oxide added to the plating solutions was easily dissolved due to alkalinity to probably give germanate ions such as $[GeO(OH)_3]^-$, $[GeO_2(OH)_2]^{2-}$, $\{[Ge(OH)_4]_8(OH)_3\}^{3-}$, etc. These ions seem to be also effective for improving mechanical properties of plated films and preventing abnormal deposition during a long period of plating like silicate ions.

The most effective concentration of germanium compound in the plating solution is 3 to 30 mmole/l as shown in Table 4 as in the case of Si compounds.

TABLE 4

| No. | Composition of electroless copper plating solution: $CuSO_4.5H_2O$ (mole/l) | EDTA.2Na (mole/l) | Formaldehyde (mole/l) | α,α'-Dipyridyl (mole/l) | Surface active agent, SA-1 (mole/l) | Ge compound (mmole/l) | Mechanical properties of plated film: Tensile strength ($kg/mm^2$) | Elongation (%) | Stability of plating solution after 100 hours' plating |
|---|---|---|---|---|---|---|---|---|---|
| 25 | 0.048 | 0.096 | 0.037 | $1.3 \times 10^{-4}$ | $2.2 \times 10^{-4}$ | $GeO_2$ 1 | 48 | 7 | x |
| 26 | " | " | " | " | " | 3 | 51 | 5 | o |
| 27 | " | " | " | " | " | 10 | 55 | 6 | o |
| 28 | " | " | " | " | " | 30 | 60 | 4 | o |
| 29 | " | " | " | " | " | 100 | 67 | 2 | o |

Notes
SA-1: See Table 1.

EXAMPLE 5

Using electroless copper plating solutions as shown in Table 5, Nos. 30 to 33, electroless copper plating was conducted in the same manner as described in Example 1. As shown in Table 5, various copper(I) ion complexing agents, surface active agents and Si or Ge compounds alone or in combination were used.

The resulting plated films had properties as shown in Table 5. As is clear from Table 5, the plated films had the same excellent tensile strength, elongation and the plating solution stability as those obtained when individual components are used alone.

TABLE 5

| No. | Composition of electroless copper plating solution: $CuSO_4.5H_2O$ (mole/l) | EDTA.2Na (mole/l) | Formaldehyde (mole/l) | Copper(I) ion complexing agent (mole/l) | Surface active agent (mole/l) | Si, Ge compound (mmole/l) | Mechanical properties of plated film: Tensile strength ($kg/mm^2$) | Elongation (%) | Stability of plating solution after 100 hours' plating |
|---|---|---|---|---|---|---|---|---|---|
| 30 | 0.05 | 0.12 | 0.054 | α,α'-Dipyridyl $1.3 \times 10^{-4}$ o-Phenanthroline $5 \times 10^{-6}$ | SA-1 $2.2 \times 10^{-4}$ | $Na_2SiO_3.9H_2O$ 3 | 53 | 4 | o |
| 31 | " | " | " | α,α'-Dipyridyl $1.3 \times 10^{-4}$ | SA-1 $2.2 \times 10^{-4}$ SA-2 $2.2 \times 10^{-4}$ | $Na_2SiO_3.9H_2O$ 3 | 53 | 6 | o |
| 32 | " | " | " | α,α'-Dipyridyl $1.3 \times 10^{-4}$ | SA-1 $2.2 \times 10^{-4}$ | $Na_2SiO_3.9H_2O$ 3 $GeO_2$ 6 | 55 | 5 | o |
| 33 | " | " | " | α,α'-Dipyridyl $1.3 \times 10^{-4}$ o-Phenanthroline $5 \times 10^{-6}$ | SA-1 $2.2 \times 10^{-4}$ SA-2 $2.2 \times 10^{-4}$ | $Na_2SiO_3.9H_2O$ 3 $GeO_2$ 6 | 51 | 6 | o |

Notes
SA-1, SA-2: See Table 1.

EXAMPLE 6

Using electroless copper plating solutions as shown in Table 6, Nos. 34 to 41, electroless copper plating was conducted in the same manner as described in Example 1. In Nos. 34 to 41, combinations of surface active agents A to D and Si or Ge compound were changed. The plating rate was about 0.5 to 3.0 μm/hr in Nos. 34 to 41 and the plating solutions were remarkably stable during the plating. Further, there was not admitted a tendency to decompose the plating solutions, said tendency being inherent to the electroless copper plating solution.

The resulting plated films of Nos. 34 to 41 were excellent in metallic copper gloss as well as in mechanical properties. Tensile strength was 50 kg/mm$^2$ or more and elongation 4% or more.

TABLE 6

| No. | Composition of electroless copper plating solution: $CuSO_4.5H_2O$ (mole/l) | EDTA.2Na (mole/l) | Formaldehyde (mole/l) | α,α'-Dipyridyl (mole/l) | Surface active agent* (mole/l) | Si, Ge compound (mmole/l) | Mechanical properties of plated film: Tensile strength (kg/mm$^2$) | Elongation (%) | Stability of plating solution after 100 hours' plating |
|---|---|---|---|---|---|---|---|---|---|
| 34 | 0.04 | 0.12 | 0.04 | $1.9 \times 10^{-4}$ | A $1.1 \times 10^{-4}$ | $Na_2SiO_3.9H_2O$ 10 | 54 | 6 | o |
| 35 | " | " | " | " | B $1.1 \times 10^{-4}$ | $Na_2SiO_3.9H_2O$ 10 | 56 | 4 | o |
| 36 | " | " | " | " | C $2.0 \times 10^{-4}$ | $Na_2SiO_3.9H_2O$ 10 | 53 | 5 | o |
| 37 | " | " | " | " | D $6.7 \times 10^{-5}$ | $Na_2SiO_3.9H_2O$ 10 | 51 | 7 | o |
| 38 | " | " | " | " | A $1.1 \times 10^{-4}$ | $GeO_2$ 10 | 55 | 5 | o |
| 39 | " | " | " | " | B $1.1 \times 10^{-4}$ | $GeO_2$ 10 | 55 | 6 | o |
| 40 | " | " | " | " | C $2.0 \times 10^{-4}$ | $GeO_2$ 10 | 50 | 8 | o |
| 41 | " | " | " | " | D $6.7 \times 10^{-5}$ | $GeO_2$ 10 | 52 | 5 | o |

Notes on Table 6:

*A = $C_{12}H_{25}COO—(CH_2CH_2O)_{15}—H$

B = 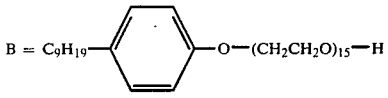

C = 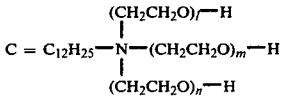

(l + m + n = 7)

D = 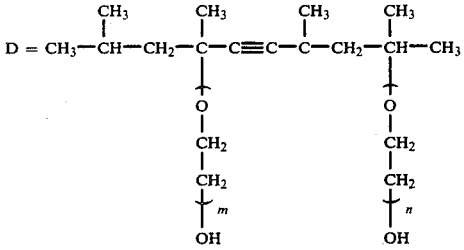

(m + n = 30)

COMPARATIVE EXAMPLE 1

Using electroless copper plating solutions as shown in Table 7, Nos. 42 to 46, electroless copper plating was conducted in the same manner as described in Example 1. In Nos. 42 to 45, although sodium metasilicate was contained in amounts of 3 to 10 mmole/l, surface active agents used were not suitable for this invention. No. 46 did not contain Si compound.

The results were as shown in Table 7.

When the surface active agents are different from those usable in this invention as shown in Nos. 42 and 43, the elongation of the plated films is poor. When a phosphoric acid ester series surface active agent is used as in No. 44, the plating reaction is stopped, although said surface active agent contains a polyoxyethylene group. The stoppage of plating reaction seems to be the excess adsorption force of the added component. When SH-192 was used as surface active agent as in No. 45, no effect of this invention was exhibited. Further, when no Si compound was added as in No. 46, mechanical properties were not improved at all.

TABLE 7

| No. | Composition of electroless copper plating solution: $CuSO_4.5H_2O$ (mole/l) | EDTA.2Na (mole/l) | Formaldehyde (mole/l) | Copper(I) ion complexing agent (mole/l) | Surface active agent* (mole/l) | Si compound (mmole/l) | Mechanical properties of plated film: Tensile strength ($kg/mm^2$) | Elongation (%) |
|---|---|---|---|---|---|---|---|---|
| 42 | 0.048 | 0.096 | 0.037 | α,α'-Dipyridyl $1.3 \times 10^{-4}$ | POE $2.2 \times 10^{-4}$ | $Na_2SiO_3.9H_2O$ 5 | 55 | 1 |
| 43 | " | " | " | α,α'-Dipyridyl $1.3 \times 10^{-4}$ | SE $2.2 \times 10^{-4}$ | 3 | 58 | 1 |
| 44 | " | " | " | o-Phenanthroline $6.4 \times 10^{-4}$ | PS-236 200 mg/l | 10 | Impossible to measure | |
| 45 | " | " | " | o-Phenanthroline $6.4 \times 10^{-4}$ | SH-192 200 mg/l | 10 | 57 | 2 |
| 46 | " | " | " | α,α'-Dipyridyl $2.2 \times 10^{-3}$ | SA-1 $2.2 \times 10^{-4}$ | 0 | 32 | 8 |

Notes on Table 7:
*POE = polyethylene glycol (mol. wt. 600)
SE = polyoxyethylene stearyl ether

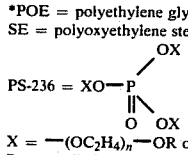

PS-236 = XO—P(=O)(OX)—OX

X = —$(OC_2H_4)_n$—OR or H
R = an alkyl group
n = an interger

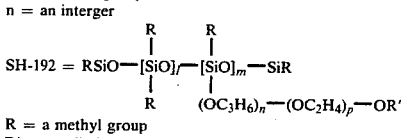

SH-192 = RSiO—[SiO]$_l$(R)—[SiO]$_m$(R)—SiR, [SiO]$_m$ side chain: $(OC_3H_6)_n$—$(OC_2H_4)_p$—OR'

R = a methyl group
R' = an alkyl group or H
l, m, n, p = intergers

COMPARATIVE EXAMPLE 2

Using electroless copper plating solutions as shown in Table 8, Nos. 47 to 49, electroless copper plating was conducted in the same manner as described in Example 1.

The results were shown in Table 8.

When no Si or Ge compound is used as in No. 47, the plated film is poor in mechanical properties. When no surface active agent is used as in No. 48, the stability of the plating solution is insufficient even if a Si compound is contained, so that the plating solution is decomposed and no plated film is obtained. When both a surface active agent and a Si or Ge compound are not contained in the plating solution as in No. 49, the degree of decomposition of the plating solution becomes greater.

TABLE 8

| No. | Composition of electroless copper plating solution: $CuSO_4.5H_2O$ (mole/l) | EDTA.2Na (mole/l) | Formaldehyde (mole/l) | α,α'-Dipyridyl (mole/l) | Surface active agent* (mole/l) | Si compound (mmole/l) | Mechanical properties of plated film: Tensile strength ($kg/mm^2$) | Elongation (%) |
|---|---|---|---|---|---|---|---|---|
| 47 | 0.04 | 0.12 | 0.04 | $1.9 \times 10^{-4}$ | $1.1 \times 10^{-4}$ | — | 33 | 8 |
| 48 | " | " | " | " | — | $Na_2SiO_3.9H_2O$ 10 | Impossible to measure | |
| 49 | " | " | " | " | — | — | Impossible to measure | |

EXAMPLE 7

To an electroless copper plating solution comprising:

| | |
|---|---|
| $CuSO_4.5H_2O$ | 10 g |
| EDTA.2Na | 30 g |
| NaOH | a sufficient amount to make the pH 12.2 |
| 37% formaldehyde solution | 3 ml |
| α,α'-dipyridyl | $3.2 \times 10^{-4}$ mole |
| polyoxyethylene series nonionic surface active agent | $1.1 \times 10^{-4}$ mole |
| Cater | an amount to make the solution 1 liter |

sodium sulfate and sodium formate as build-up component in the plating solution were added in various concentrations to measure changes of cloud points of the plating solution. As the polyoxyethylene series nonionic surface active agent, polyethylene glycol stearylamine was used. The temperature at which polyethylene glycol stearylamine agglomerates was defined as a cloud point of plating solution. The cloud points of the plating solutions were measured and listed in Table 9.

TABLE 9

| Concentration of anions (g/l) | | Cloud point of plating solution |
|---|---|---|
| $Na_2SO_4$ | HCOONa | (°C.) |
| 7.0 | 0 | 90 |
| 14.0 | 6.8 | 85 |
| 21.0 | 13.6 | 79 |
| 28.0 | 20.4 | 75 |
| 36.0 | 27.2 | 69 |
| 45.0 | 34.0 | 65 |

As is clear from Table 9, the cloud point decreases linearly with an increase of adding amounts of sodium sulfate and sodium formate.

Next, the effect of various ionic surface active agents on the increase of cloud point of plating solution was examined by using the above-mentioned plating solution further containing 28.0 g/l of sodium sulfate ($SO_4^{2-}$ concentration in the plating solution: 112 g/l) and 20.4 g/l of sodium formate ($HCOO^-$ concentration in the plating solution: 102 g/l). The results are shown in the attached drawing. As is clear from the drawing, the effect of increasing the cloud point of plating solution is most remarkable in the case of cationic surface active agents (the curve A=cetyltrimethylammonium chloride, the curve B=dodecylpyridinium chloride), next effective in the case of amphoteric surface active agents (the curve D=stearyl betaine), and slightly effective in the case of anionic surface active agents (the curve C=dodecylbenzene sulfonate, the curve E=sulfosuccinic acid ester, the curve F=sodium polyoxyethylene laurylsulfate).

In the next place, influences of various polyoxyethylene series nonionic surface active agents on the increasing effect of cetyltrimethylammonium chloride on the cloud point were examined by using the above-mentioned plating solution further containing 50 mg/l of cetyltrimethylammonium chloride, 28.0 g/l of sodium sulfate and 20.4 g/l of sodium formate.

The results are shown in Table 10.

TABLE 10

| Polyoxyethylene series nonionic surface active agent | Cloud point (°C.) No addition | Cloud point (°C.) Added |
|---|---|---|
| TETORONICS 704 | 60 | 95 |
| TETORONICS 707 | 95 | >100 |
| PLURONICS L64 | 52 | 87 |
| PLURONICS P85 | 79 | >100 |
| Polyoxyethylene octylphenol ether | 58 | 92 |
| Polyoxyethylene lauryl ether | 69 | >100 |

Notes on Table 10:
TETORONICS, PLURONICS = Polyoxyethylene-polyoxypropylene block polymer manufactured by Asahi Denka Kogyo K.K.

As is clear from Table 10, the cloud point is increased in all the cases irrespective of the kinds of polyoxyethylene series nonionic surface active agents.

EXAMPLE 8

An electroless copper plating solution was prepared by adding 50 mg of cetyltrimethylammonium chloride to 1 liter of the following composition:

| | |
|---|---|
| $CuSO_4.5H_2O$ | 10 g |
| EDTA.2Na | 30 g |
| NaOH | a sufficient amount to make the pH 12.2 |
| α,α'-dipyridyl | 40 mg |
| 37% formaldehyde solution | 3 ml |
| polyethylene glycol stearylamine | 100 mg |
| water | an amount to make the solution 1 liter |

Electroless copper plating was conducted in the same manner as described in Example 1. Even when the total plating time reached 100 hours, foaming properties of the plating solution was still admitted (the effect of the surface active agent remaining) and no abnormal deposition (copper deposition on outside the desired portion of an insulating material) was not admitted.

The resulting plated film at the inital stage had excellent mechanical properties, i.e., tensile strength of 52 kg/mm² and elongation of 6%.

EXAMPLE 9

| | |
|---|---|
| $CuSO_4.5H_2O$ | 10 g |
| EDTA.2Na | 30 g |
| NaOH | a sufficient amount to make the pH 12.1 |
| 37% formaldehyde solution | 3 ml |
| o-phenanthroline | 1 mg |
| polyoxyethylene laurylamine | 200 mg |
| laurylbenzyldimethylammonium chloride | 50 mg |
| water | an amount to make the solution 1 liter |

Using the above-mentioned electroless copper plating solution, electroless copper plating was conducted for 120 hours in the same manner as described in Example 1, but no abnormal deposition was admitted.

The resulting plated film at the inital stage had excellent mechanical properties, i.e., tensile strength of 55 kg/mm² and elongation of 4%.

EXAMPLE 10

| | |
|---|---|
| $CuSO_4.5H_2O$ | 15 g |
| EDTA.2Na | 45 g |
| NaOH | a sufficient amount to make the pH 12.3 |
| 37% formaldehyde solution | 3 ml |
| α,α'-dipyridyl | $1.9 \times 10^{-4}$ mole |
| polyethylene glycol stearylamine (n = 15) | $1.1 \times 10^{-4}$ mole |
| cetyltrimethylammonium chloride | $1.4 \times 10^{-4}$ mole |
| laurylbenzyldimethylammonium chloride | $2.0 \times 10^{-4}$ mole |
| water | an amount to make the solution 1 liter |

Using the above-mentioned electroless copper plating solution, electroless copper plating was conducted for 120 hours in the same manner as described in Example 1, but no abnormal deposition was admitted, since a mixture of two kinds of cationic surface active agents were used.

The resulting plated film had excellent mechanical properties, i.e., tensile strength of 52 kg/mm² and elongation of 5%.

EXAMPLE 11

| | |
|---|---|
| $CuSO_4.5H_2O$ | 15 g |
| EDTA.2Na | 45 g |
| NaOH | a sufficient amount to make the pH 12.3 |
| 37% formaldehyde solution | 3 ml |
| α,α'-dipyridyl | $1.9 \times 10^{-4}$ mole |
| polyethylene glycol stearylamine (n = 15) | $1.1 \times 10^{-4}$ mole |
| polyoxyethylene laurylamine (n = 20) | $9.4 \times 10^{-5}$ mole |
| cetyltrimethylammonium chloride | $1.4 \times 10^{-4}$ mole |
| water | an amount to make the solution 1 liter |

Using the above-mentioned electroless copper plating solution, electroless copper plating was conducted for 120 hours in the same manner as described in Example 1, but no abnormal deposition was admitted, since two kinds of nonionic polyoxyethylene surface active agents and a cationic surface active agent were co-used.

The resulting plated film had excellent mechanical properties, i.e., tensile strength of 55 kg/mm$^2$ and elongation of 5%.

EXAMPLE 12

[I] Composition of electroless copper plating solution

| | |
|---|---|
| $CuSO_4.5H_2O$ | 0.048 mole |
| EDTA.2Na | 0.11 mole |
| NaOH | a sufficient amount to make the pH 12.2 |
| 37% formaldehyde solution | 4 ml |
| α,α'-dipyridyl | $3.5 \times 10^{-4}$ mole |
| polyethylene glycol stearylamine | $1.1 \times 10^{-4}$ mole |
| sodium metasilicate | $3.5 \times 10^{-3}$ mole |
| water | an amount to make the solution 1 liter |

[II] Conditions of plating (i) plating temperature: 70° C.
(ii) plating load factor: 100 cm$^2$/l
(iii) volume of plating tank: 50 liters

[III] Experimental method

In order to know influences of substances dissolved into the plating solution from a substrate for printed wiring board, a substrate made from an epoxy resin (thickness 1.6 mm, no copper foil on both sides) was used.

A stainless steel plate and the epoxy resin substrate were dipped in the plating solution at 100 cm$^2$/l and electroless copper plating was conducted on the stainless steel plate, while dissolution of the epoxy resin substrate into the plating solution was carried out at the same time.

After plating to the thickness of 35 μm, the plated film was peeled off from the stainless steel plate and cut into a size of 1×10 cm. Mechanical properties of the plated film were measured by using a tensile tester by a conventional method.

The number of plating means the number of repeating so as to make the thickness 35 μm at the plating load factor of 100 cm$^2$/l.

With the progress of plating, the concentrations of plating reaction components in the plating solution were decreased. But the concentrations of these components were always maintained constant by means of automatic analysis of these concentrations and automatic supplement of consumed components.

Tensile strength of resulting plated film was measured and listed in Table 11-1.

TABLE 11-1

| No. of plating | 1 | 2 | 4 | 5 |
|---|---|---|---|---|
| Tensile strength (kg/mm$^2$) | 42 | 26 | 20 | Plating was stopped |

Since substances dissolved from the epoxy resin substrate made the plating solution unstable and the tensile strength of the resulting plated films was lowered as shown in Table 11-1, the electroless plating was stopped at the fifth plating.

On the other hand, when the following cationic surface active agent, i.e.

| |
|---|
| hexadecyltrimethylammonium bromide: $1.4 \times 10^{-4}$ mole/l $[C_{16}H_{33}N(CH_3)_3]Br$ |

was added to the same electroless copper plating solution as mentioned above, electroless copper plating was able to be repeated 10 times (about 150 hours) even if the epoxy resin substrate was dipped in the plating solution.

The results are shown in Table 11-2.

TABLE 11-2

| No. of plating | 1 | 2 | 4 | 6 | 8 | 10 |
|---|---|---|---|---|---|---|
| Tensile strength (kg/mm$^2$) | 61 | 60 | 58 | 55 | 55 | 56 |
| Elongation (%) | 4 | 5 | 6 | 7 | 7 | 6 |

As is clear from Table 11-2, the plated film obtained at the first plating had tensile strength of 61 kg/mm$^2$ and elongation of 4% as well as mirror-like gloss. It is a very surprising thing that no deposition on the walls of the plating tank took place even after 10 times plating (about 150 hours' plating).

This clearly means that the cationic surface active agent is effective for preventing the plating solution from the influences of substances dissolved out of the epoxy resin substrate.

The same effect as mentioned above was identified when a plating tank having a volume of 5000 liters was used. That is, even after repeating the electroless copper plating 10 times, the resulting plated film had excellent mechanical properties, i.e., tensile strength of 56 kg/mm$^2$ and elongation of 6%.

EXAMPLE 13

The process of Example 12 using the cationic surface active agent was repeated except for using Si, Ge or V compound in amounts as listed in Table 12.

The results are as shown in Table 12.

As is clear from Table 12, excellent results are obtained in the portions marked with o.

TABLE 12

| Si, Ge, or V compound | Adding amount (mmole/l in terms of Si, Ge or V atom.) 0.0006 | 0.001 | 0.01 | 1 | 3 | 10 | 30 | 50 | 100 | 200 |
|---|---|---|---|---|---|---|---|---|---|---|
| $Na_2SiO_3.9H_2O$ | x | x | x | o | o | o | o | o | x | x |
| $Na_2SiO_4$ | x | x | x | x | o | o | o | o | x | x |
| $GeO_2$ | x | x | x | x | o | o | o | x | x | x |
| $V_2O_5$ | x | x | x | o | o | o | o | x | x | x |
| $VOSO_4.2H_2O$ | x | x | x | o | o | o | o | x | x | x |

Notes
o: Plated film had tensile strength of 50 kg/mm$^2$ or more and elongation of 4% or more, and no abnormal deposition took place even after continuous 100 hours' plating.
x: Either plated film had tensile strength of less than 50 kg/mm$^2$ and elongation of less than 4%, or abnormal deposition took place after continuous 100 hours' plating.

EXAMPLE 14

The process of Example 12 using the cationic surface active agent was repeated except for using cationic surface active agents as listed in Table 13 in place of hexadecyltrimethylammonium bromide.

The results are as shown in Table 13.

As is clear from Table 13, excellent results are obtained in the portions marked with o.

TABLE 13

| Cationic surface active agent | Adding amount (mmole/l) 0.01 | 0.02 | 0.1 | 1 | 2 | 5 |
|---|---|---|---|---|---|---|
| Hexadecyltrimethylammonium bromide $[C_{16}H_{33}N(CH_3)_3]Br$ | x | o | o | o | o | x |
| Stearyldimethylbenzyl-ammonium chloride 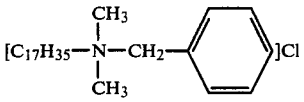 | x | o | o | o | o | x |
| Dodecylpyridinium chloride 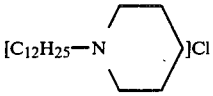 | x | o | o | o | o | x |

Notes
o, x: See Table 12.

EXAMPLE 15

The process of Example 12 using the cationic surface active agent was repeated except for using polyoxyethylene series nonionic surface active agents as listed in Table 14 were used in place of polyethylene glycol stearylamine.

The results are as shown in Table 14.

As is clear from Table 14, excellent results are obtained in the portions marked with o.

TABLE 14

| Polyoxyethylene nonionic surface active agent | Adding amount (mmole/l) $5 \times 10^{-3}$ | 0.01 | 0.05 | 0.1 | 1 | 2 | 5 |
|---|---|---|---|---|---|---|---|
| $C_{18}H_{37}—NH—(C_2H_4O)_{15}—H$ | x | o | o | o | o | o | x |
| $C_{18}H_{37}—N[(C_2H_4O)_{10}—H]_2$ | x | o | o | o | o | x | x |

Notes
o, x: See Table 12.

COMPARATIVE EXAMPLE 3

Using the following electroless copper plating solution, electroless copper plating was conducted in the same manner as described in Example 12.

| | |
|---|---|
| $CuSO_4.5H_2O$ | 15 g |
| EDTA.2Na | 45 g |
| 37% formaldehyde solution | 3 ml |
| NaOH | a sufficient amount to make the pH 12.1 |
| $\alpha,\alpha'$-dipyridyl | $1.9 \times 10^{-4}$ mole |
| polyethylene glycol (mol. wt. 600) | $1.7 \times 10^{-4}$ mole |
| sodium metasilicate | $1.0 \times 10^{-4}$ mole |
| water | an amount to make the solution 1 liter |

Abnormal deposition took place after about 50 hours' continuous plating; that is, the stability of the plating solution was not good.

What is claimed is:

1. An electroless copper plating solution comprising:
(a) copper ions,
(b) a copper(II) ion complexing agent,
(c) a reducing agent selected from the group consisting of formaldehyde, paraformaldehyde and borohydrides,
(d) a pH adjustor,
(e) a polyoxyethylene series surface active agent selected from the group consisting of amine series polyoxyethylene surface active agents, alkylamine series polyoxyethylene surface active agents, alkyl ester series polyoxyethylene surface active agents, alkyl aryl ether series polyoxyethylene surface active agents and acetylene-bond-containing polyoxyethylene surface active agents, and mixtures thereof,
(f) a copper(I) ion complexing agent, and
(g) (i) an inorganic compound containing at least silicon or germanium, or
(ii) a cationic surface active agent, or
(iii) an inorganic compound containing at least silicon, germanium or vanadium and a cationic surface active agent.

2. An electroless copper plating solution according to claim 1, wherein the component (g) is
(i) an inorganic compound containing at least silicon or germanium in an amount of 2 mmole/l or more in terms of silicon or germanium atom.

3. An electroless copper plating solution according to claim 1, wherein the component (g) is
(ii) a cationic surface active agent.

4. An electroless copper plating solution according to claim 1, wherein the component (g) is
(iii) an inorganic compound containing at least silicon, germanium or vanadium in an amount of 2 mmole/l or more in terms of silicon, germanium or vanadium atom and a cation surface active agent.

5. An electroless copper plating solution according to claim 2, wherein the inorganic compound containing at least silicon or germanium is used in an amount of 3 to 30 mmole/l in terms of silicon or germanium atom.

6. An electroless copper plating solution according to claim 2, wherein the inorganic compound containing at least silicon or germanium is at least one member selected from the group consisting of silicon, orthosilicates, metasilicates, silicon hydride, germanium, germanium oxide and germanium hydride.

7. An electroless copper plating solution according to claim 3, wherein the cationic surface active agent is used in an amount of 0.02 to 2 mmole/l.

8. An electroless copper plating solution according to claim 3, wherein the cationic surface active agent is at least one member selected from the group consisting of quaternary ammonium salts and pyridinium salts.

9. An electroless copper plating solution according to claim 4, wherein the inorganic compound containing at least silicon, germanium or vanadium is used in an amount of 2 to 100 mmole/l in terms of silicon, germanium or vanadium atom and the cationic surface active agent is used in an amount of 0.02 to 2 mmole/l.

10. An electroless copper plating solution according to claim 4, wherein the inorganic compound containing at least silicon, germanium or vanadium is at least one member selected from the group consisting of silicon, orthosilicates, metasilicates, silicon hydride, germanium, germanium oxide, germanium hydride, vanadium, vanadium oxide, and metavanadates, and the cation surface active agent is at least one member selected from the group consisting of quaternary ammonium salts and pyridinium salts.

11. An electroless copper plating solution according to claim 1, wherein the polyoxyethylene series surface active agent is one or more amine series polyoxyethylene surface active agents.

12. An electroless copper plating solution according to claim 2, which comprises (a) cupric sulfate,
(b) ethylenediaminetetraacetic acid disodium salt,
(c) formaldehyde,
(d) sodium hydroxide,
(e) a polyethylene glycol alkylamine,
(f) $\alpha,\alpha'$-dipyridyl, and
(g) (i) sodium silicate.

13. An electroless copper plating solution according to claim 3, which comprises (a) cupric sulfate,
(b) ethylenediaminetetraacetic acid disodium salt,
(c) formaldehyde,
(d) sodium hydroxide,
(e) a polyethylene glycol alkylamine,
(f) $\alpha,\alpha'$-dipyridyl, and
(g) (ii) at least one alkyltrimethylammonium salt.

14. An electroless copper plating solution according to claim 4, which comprises (a) cupric sulfate,
(b) ethylenediaminetetraacetic acid disodium salt,
(c) formaldehyde,
(d) sodium hydroxide,
(e) a polyethylene glycol alkylamine,
(f) $\alpha,\alpha'$-dipyridyl, and
(g) (iii) sodium silicate and at least one alkyltrimethylammonium salt.

15. An electroless copper plating solution according to claim 1, wherein component (g) is (g) (i) or (g) (iii).

16. An electroless copper plating solution according to claim 1, wherein said copper(I) ion complexing agent is selected from the group consisting of $\alpha,\alpha'$-dipyridyl and derivatives thereof, o-phenanthroline and derivatives thereof, cuproine, bathocuproine, and compounds containing —CN group, and mixtures thereof.

17. An electroless copper plating solution according to claim 16, wherein said copper(I) ion complexing agent is used in an amount of 0.001 to 1 mmole/l.

18. An electroless copper plating solution according to claim 1, wherein said polyoxyethylene series surface active agent is selected from the group consisting of polyethylene glycol stearylamine and

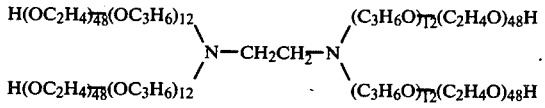

19. An electroless copper plating solution according to claim 1, wherein said polyoxyethylene series surface active agent is an amine series polyoxyethylene surface active agent of the formula:

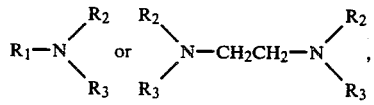

where $R_1$ is an alkyl group; and $R_2$ and $R_3$ are independently a hydrogen atom, a group of the formula $(CH_2CH_2O)_n$—H, or a group of the formula:

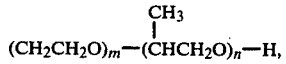

with m and n independently being 5–150.

20. An electroless copper plating solution according to claim 1, wherein said polyoxyethylene series surface active agent is an alkylamine series polyoxyethylene surface active agent of the formula:

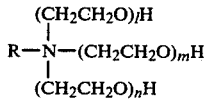

where R is an alkyl group and l, m and n are independently 5–150.

21. An electroless copper plating solution according to claim 1, wherein said polyoxyethylene series surface active agent is an alkyl ester series polyoxyethylene surface active agent of the formula:

$$R—COO—(CH_2CH_2O)_n—H$$

where R is an alkyl group and n is 5–150.

22. An electroless copper plating solution according to claim 1, wherein said polyoxyethylene series surface active agent is an alkyl aryl ether series polyoxyethylene surface active agent of the formula:

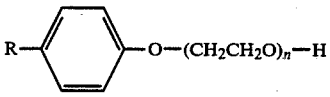

where R is an alkyl group and n is 5–150.

23. An electroless copper plating solution according to claim 1, wherein said polyoxyethylene series surface active agent is an acetylene-bond-containing polyoxyethylene surface active agent of the formula:

23
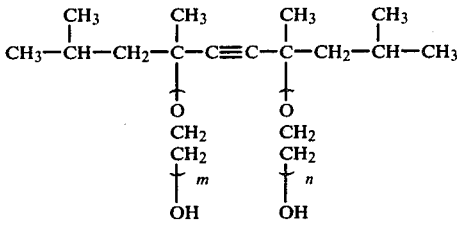
where m and n are independently 5–150.
24
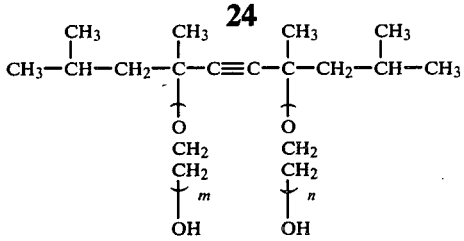
where m and n are independently 5–150.